US006305902B1

(12) United States Patent
Konishi et al.

(10) Patent No.: US 6,305,902 B1
(45) Date of Patent: Oct. 23, 2001

(54) STEAM TURBINE STATIONARY BLADE

(75) Inventors: Tetsu Konishi; Ryotaro Magoshi; Hideyuki Toda; Takaaki Matsuo; Eiichiro Watanabe, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/422,459

(22) Filed: Oct. 21, 1999

(51) Int. Cl.[7] ..... F01D 5/14
(52) U.S. Cl. ..... 415/115
(58) Field of Search ..... 415/115; 416/97 R

(56) References Cited

U.S. PATENT DOCUMENTS

| | | | | |
|---|---|---|---|---|
| 1,829,674 | * | 10/1931 | Rosenlocher | 415/115 X |
| 3,672,787 | * | 6/1972 | Thorstenson | 416/97 R |
| 5,342,172 | * | 8/1994 | Coudray et al. | 416/97 R |
| 5,352,091 | * | 10/1994 | Sylvestro | 416/97 R |
| 5,494,402 | * | 2/1996 | Glezer et al. | 415/115 |

FOREIGN PATENT DOCUMENTS

| | | |
|---|---|---|
| 0233332 | 8/1987 | (EP) . |
| 1072483 | 6/1967 | (GB) . |
| 62271905 | 11/1987 | (JP) . |
| 01045904 | 2/1989 | (JP) . |
| 06173607 | 6/1994 | (JP) . |

* cited by examiner

*Primary Examiner*—John E. Ryznic
(74) *Attorney, Agent, or Firm*—Wenderoth, Lind & Ponack, L.L.P.

(57) ABSTRACT

Precision cast hollow stationary blade used for final stage of steam turbine is improved to enhance drain recovery efficiency. Hollows (4, 5), sectioned by rib (6) to be independent of each other, are formed in stationary blade (1) passing therethrough from outer shroud 2 to inner shroud 3. A plurality of ventral slits (10 to 20) are provided on blade surface ventral side linearly with predetermined interval between the slits in two parallel rows. Dorsal slits (21 to 26) are also provided linearly with predetermined interval between the slits. Drain on blade surface enters the hollows (5, 4) through the ventral slits (10 to 20) and the dorsal slits (21 to 26), respectively, and flows out of the outer shroud (2) or the inner shroud (3) as drain (40 to 43) to be recovered. While prior art hollow is single hollow and drain entering the hollow through the dorsal slits flows out through the ventral slits or reverse case thereof occurs, the hollows (4, 5) of the present invention being sectioned by the rib (6), the drain is prevented from flowing out to the opposite side.

5 Claims, 6 Drawing Sheets

STEAM TURBINE STATIONARY BLADE

BACKGROUND OF THE INVENTION

1. Field of the Invention

The present invention relates generally to a stationary blade of a steam turbine and more particularly to a stationary blade applied as a precision cast hollow blade which is used for a final stage of a steam turbine and has an enhanced drain removal efficiency of its blade surface.

2. Description of the Prior Art

As for a final stage stationary blade of a steam turbine, steam which has worked on a front stage side thereof passes through it and as the temperature of the steam becomes lower, the blade is not specifically cooled. Although drain comes out on a blade surface, it is a present situation that there are provided slits for recovering the drain through which the drain is led into a blade interior to be recovered through a hollow therein.

FIG. 5 is a perspective view of a precision cast hollow blade used in a steam turbine in the prior art, as mentioned above. In FIG. 5, numeral 2 designates an outer shroud, numeral 3 designates an inner shroud and numeral 31 designates a stationary blade, which is a precision cast blade to be used for a final stage of the steam turbine and has a hollow formed therein. Numeral 32 designates the hollow in the blade interior, which is formed as a single hollow. Numerals 33, 34, respectively, designate a plurality of ventral slits, which are provided in the blade surface linearly with a predetermined interval between each of the slits so that two rows of the ventral slits are arranged in parallel with each other. Numeral 35 designates a plurality of dorsal slits provided likewise in the blade surface. The ventral slits 33, 34 and the dorsal slits 35 are provided to open at the blade surface and communicate with the hollow 32 so that the drain may flow therethrough into the blade interior.

FIG. 6 is a cross sectional view taken on line G—G of FIG. 5. As mentioned above, the single hollow 32 is formed in the stationary blade 31 and the ventral slits 33, 34 are provided in a ventral portion of the stationary blade 31 to pass through from the blade surface to the hollow 32. Likewise, the dorsal slit 35 is provided in a dorsal portion of the stationary blade 31 to pass through from the blade surface to the hollow 32.

In the steam turbine stationary blade constructed as mentioned above, drain 50 on the blade surface flows into the ventral slits 33, 34 and the dorsal slits 35 to be led into the hollow 32 and then passes through the outer shroud 2 or the inner shroud 3 to be recovered into a condenser (not shown) via a pipe system (not shown). In the process of such flow of the drain 50 which has been led into the hollow 32 through the ventral slits 33, 34 and the dorsal slits 35, there is a problem in operation that the drain so led into the hollow 32 through the dorsal slits 35 moves along an inner wall of the hollow 32 to flow out again through the ventral slits 33, 34 or a reverse case thereof occurs, and an improvement in terms of a drain removal efficiency is desired.

That is, in the precision cast hollow stationary blade of a steam turbine in the prior art as mentioned above, there occurs a case that the drain recovered into the hollow 32 through the dorsal slits 35, or through the ventral slits 33 34, moves along the inner wall of the hollow 32 to flow out again through the ventral slits 33, 34, or through the dorsal slits 35, respectively, which results in lowering the drain recovery efficiency.

SUMMARY OF THE INVENTION

In view of the above-mentioned problem in the prior art, it is an object of the present invention to provide a steam turbine stationary blade comprising a structure to section a drain flow passage into two portions, one for recovering drain through dorsal slits and one for recovering drain through ventral slits so that the drain recovered into a hollow through the dorsal slits may not flow out again through the ventral slits or a reverse case thereof may not occur.

In order to achieve this object, the present invention provides the following means.

The steam turbine stationary blade comprises a hollow passing through an interior of the blade from an outer shroud to an inner shroud and a plurality of slits, formed on a ventral side and a dorsal side of the blade so as to communicate with the hollow from a surface of the blade, extending in a lengthwise direction of the blade with a predetermined interval between each of the slits. The hollow is characterized in that it is sectioned into a leading edge side hollow on a leading edge side of the blade and a trailing edge side hollow on a trailing edge side of the blade. The leading edge side hollow and the trailing edge side hollow are independent of each other so that the slits formed on the dorsal side communicate with the leading edge side hollow and the slits formed on the ventral side communicate with the trailing edge side hollow.

In the steam turbine stationary blade according to the present invention, the hollow in the blade is sectioned into the leading edge side and the trailing edge side so as to be independent of each other, thereby the drain entering the leading edge side hollow from the dorsal slits and that entering the trailing edge side hollow from the ventral slits are separated from each other. Due to this sectioning, no case occurs where the drain recovered through the dorsal slits flows out through the ventral slits or the drain flows out reversely thereof, and a secure recovery of the drain can be accomplished. In the prior art case, there is provided only a single hollow and there occurs a case where the drain recovered into the hollow through the dorsal slits flows out to the blade surface through the ventral slits or the drain flows out reversely thereof, but in the present invention, no such shortcomings occur.

DESCRIPTION OF THE PREFERRED EMBODIMENT

Figure 1:
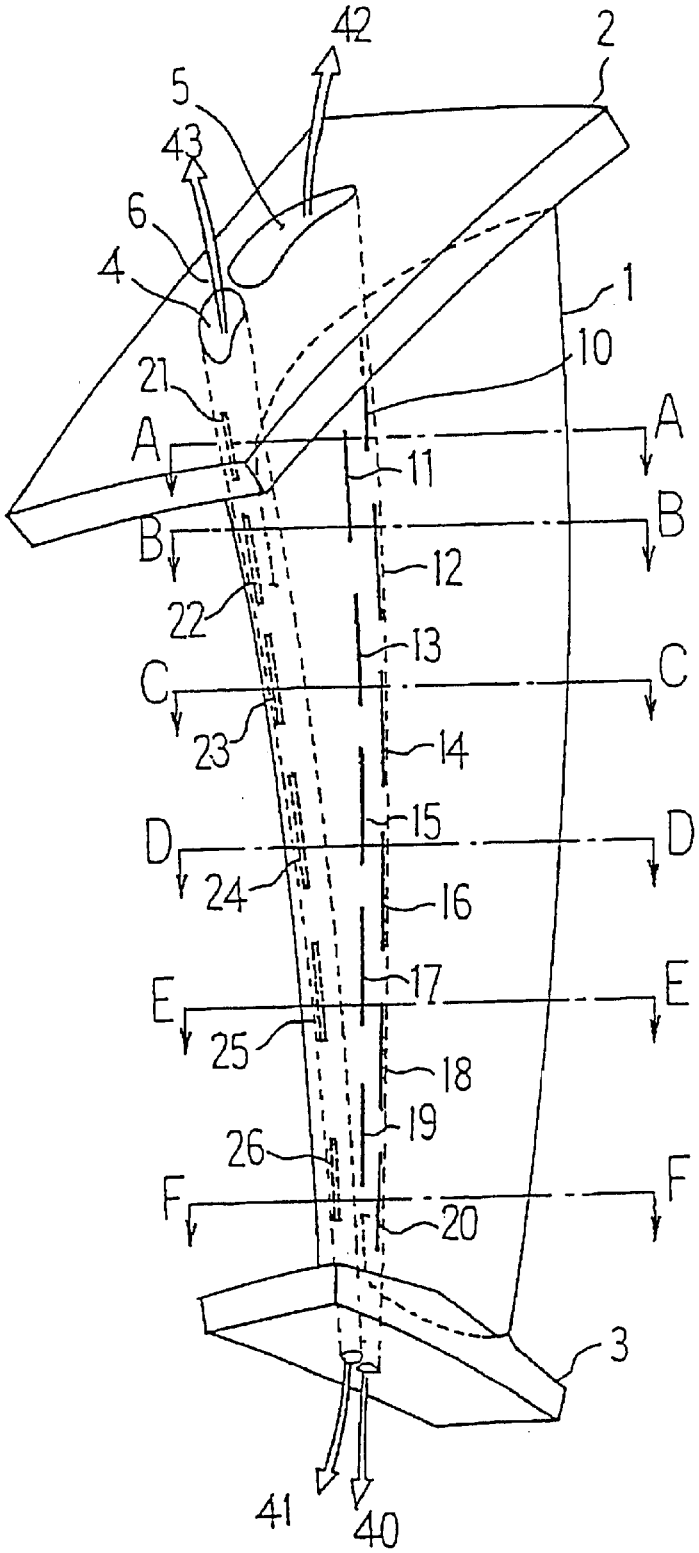
FIG. 1 is a perspective view of a steam turbine stationary blade of an embodiment according to the present FIGS. 2(*a*)–(*c*) show cross sections of various portions of the stationary blade of FIG. 1, wherein FIG. 2(*a*) is a view taken on line A—A, FIG. 2(*b*) is that taken on line B—B and FIG. 2(*c*) is that taken on line C—C.

Herebelow, an embodiment according to the present invention will be described concretely with reference to figures. FIG. 1 is a perspective view of a steam turbine stationary blade of an embodiment according to the present invention. In FIG. 1, numeral 1 designates a stationary blade, which is a precision cast hollow blade to be used for a final stage of a steam turbine. Numeral 2 designates an outer shroud and numeral 3 designates an inner shroud. Numeral 4 designates a leading edge side hollow, which is formed in the stationary blade 1 on a leading edge side thereof, numeral 5 designates a trailing edge side hollow, which is formed in the stationary blade 1 on a trailing edge side thereof and numeral 6 designates a rib, which is provided between the leading edge side hollow 4 and the trailing edge side hollow 5 for sectioning them. Both of the hollows 4, 5 are formed so as to pass through the stationary blade 1 from the outer shroud 2 to the inner shroud 3.

Numerals 10 to 20 designate a plurality of ventral slits, which are provided in a blade surface of the stationary blade 1 so as to communicate with the trailing edge side hollow 5. The ventral slits 10, 12, 14, 16, 18 and 20 are arranged linearly with a predetermined interval between each of the slits along a lengthwise direction thereof. Likewise, the ventral slits 11, 13, 15, 17 and 19 are arranged linearly with a predetermined interval between each of the slits along a lengthwise direction thereof so that two rows of the ventral slits are arranged in parallel with each other.

Numerals 21 to 26 designate a plurality of dorsal slits, which are provided in the blade surface of the stationary blade 1 so as to communicate with the leading edge side hollow 4. These dorsal slits are arranged linearly with a predetermined interval between each of the slits along a lengthwise direction thereof.

As concrete dimensions of the mentioned ventral and dorsal slits, it is preferable in terms of recovering drain into the hollows 4, 5 that the distance between the parallel rows of the ventral slits is about 10 mm and a width of each of the slits is about 2 mm.

Figure 2:
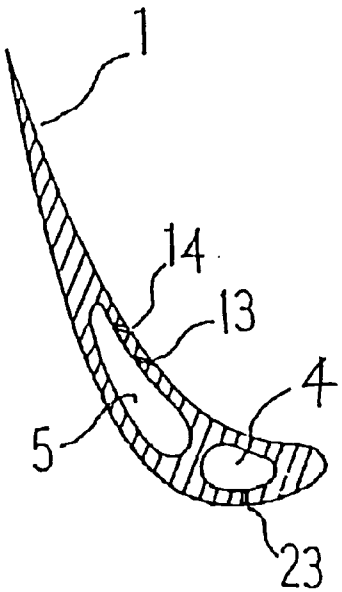
Figure 2:
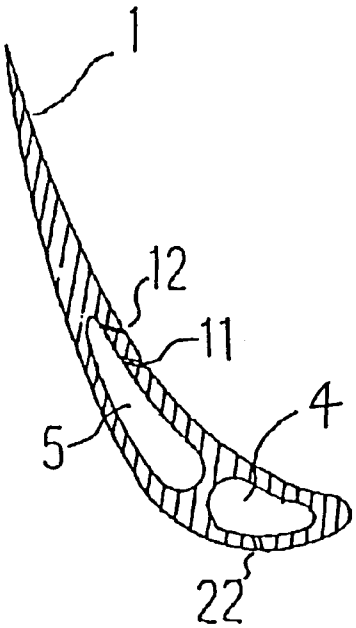
Figure 2:
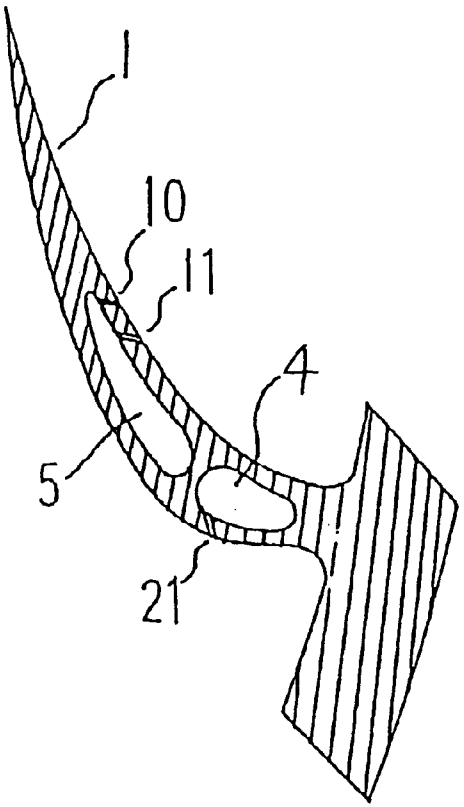

FIGS. 2(*a*)–(*c*) show cross sections of various portions of the stationary blade of FIG. 1, wherein FIG. 2(*a*) is a view taken on line A—A, FIG. 2(*b*) is that taken on line B—B and FIG. 2(*c*) is that taken on line C—C. There are shown at the respective positions the ventral slits 10, 11 and the dorsal slit 21 in FIG. 2(*a*), the ventral slits 11, 12 and the dorsal slit 22 in FIG. 2(*b*) and the ventral slits 13, 14 and the dorsal slit 23 in FIG. 2(*c*).

Figure 3C:
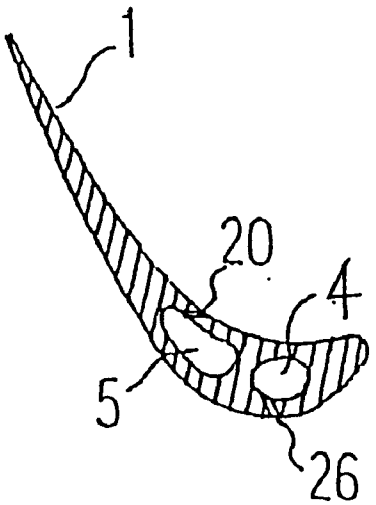
FIGS. 3(*a*)–(*c*) show also cross sections of various portions of the stationary blade of FIG. 1, wherein FIG. 3(*a*) is a view taken on line D—D, FIG. 3(*b*) is that taken on line E—E and FIG. 3(*c*) is that taken on line F—F.
Figure 3B:
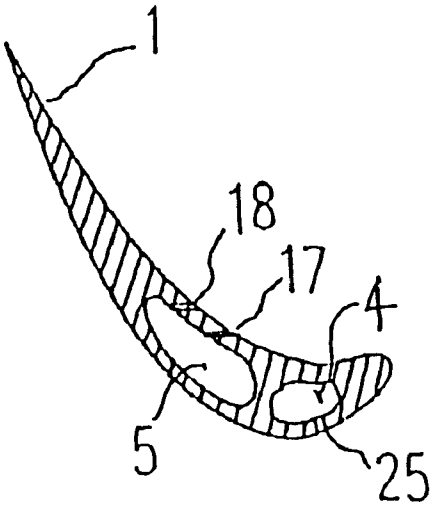
Figure 3A:
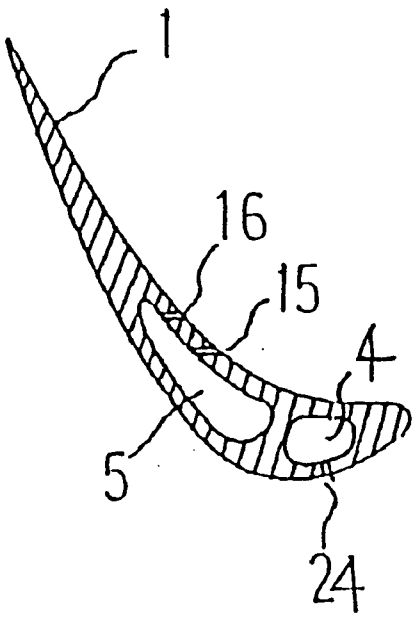

FIGS. 3(*a*)–(*c*) likewise show cross sections of various portions of the stationary blade of FIG. 1, wherein FIG. 3(*a*) is a view taken on line D—D, FIG. 3(*b*) is that taken on line E—E and FIG. 3(*c*) is that taken on line F—F, and there are shown at the respective positions the ventral slits 15, 16 and the dorsal slit 24 in FIG. 3(*a*), the ventral slits 17, 18 and the dorsal slit 25 in FIG. 3(*b*) and the ventral slit 20 and the dorsal slit 26 in FIG. 3(*c*).

Figure 4:
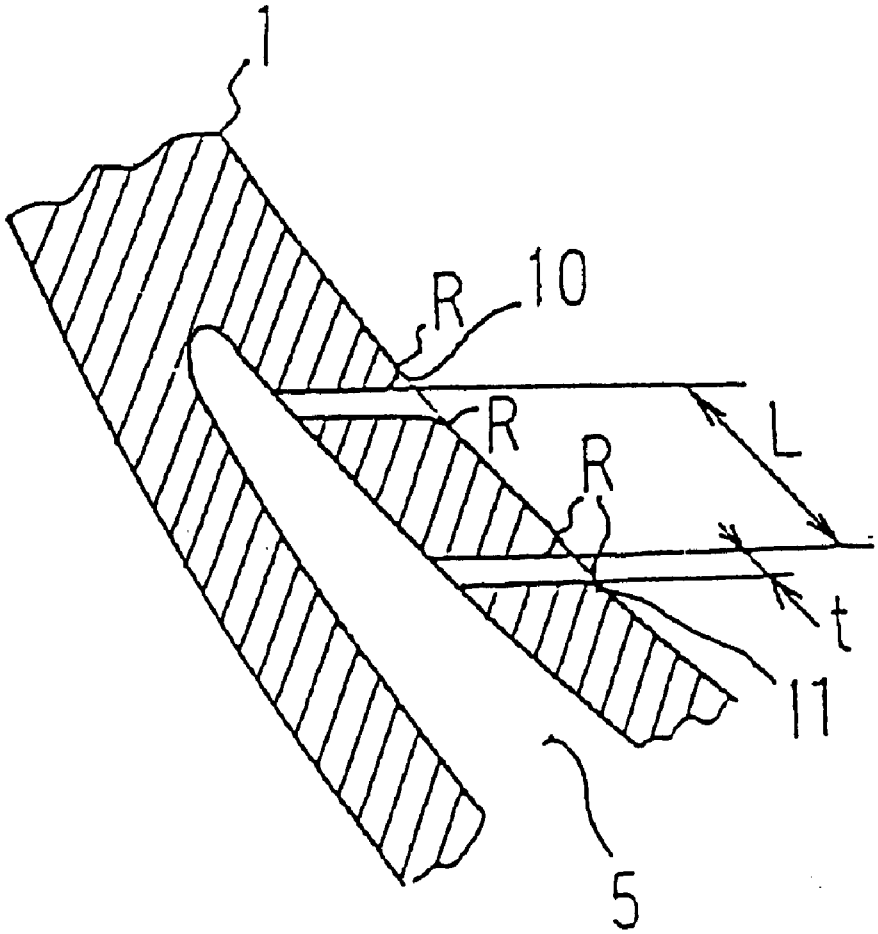
FIG. 4 is a partially enlarged cross sectional view of a slit shape which is represented by ventral slits 10, 11 of the embodiment of FIG. 1.
Figure 5:
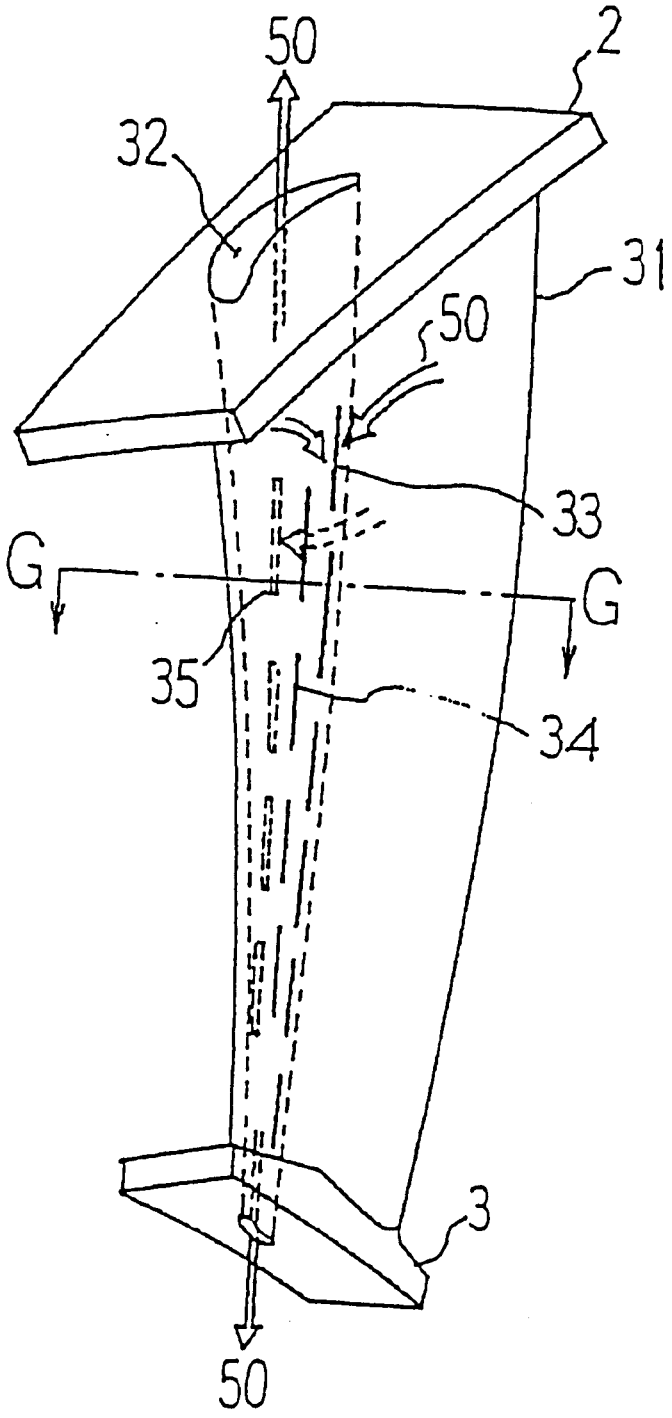
Fig. 5 (Prior Art)
FIG. 5 is a perspective view of a steam turbine stationary blade in the prior art.
Figure 6:
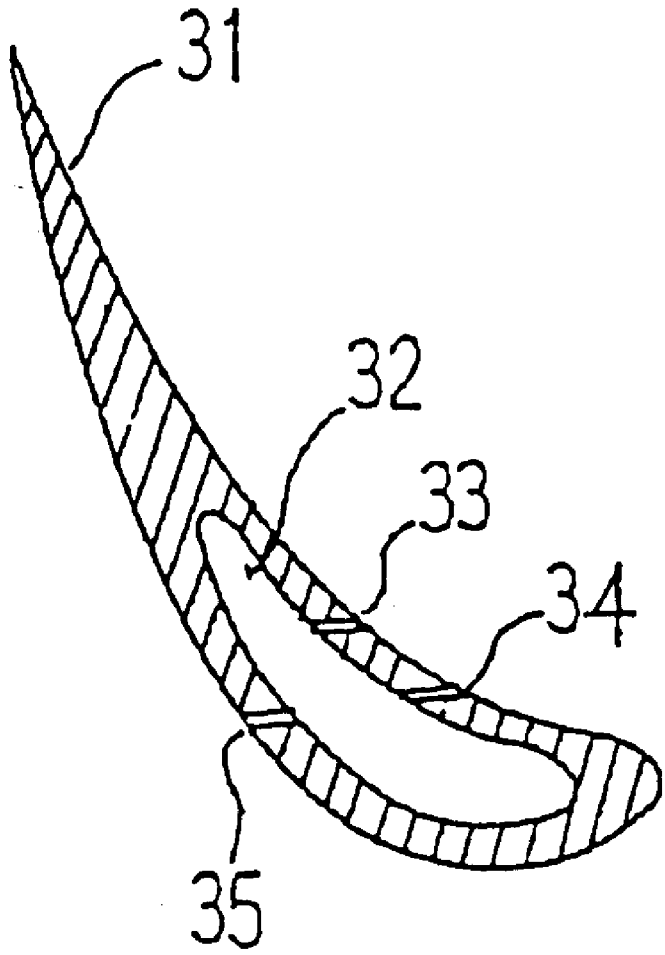
Fig. 6 (Prior Art)
FIG. 6 is a cross sectional view taken on line G—G of FIG. 5.

FIG. 4 is a partially enlarged cross sectional view of a slit shape which is represented by the ventral slits 10, 11. As shown there, where L is a distance between the parallel ventral slits 10, 11 and t is a width of the slit, it is preferable that L equals about 10 mm and t equals about 2 mm, as mentioned above. Also, each corner portion of the slit at the blade surface is made in a round form (rounded edges), as shown by R, so that the drain may easily flow into the hollow 5 from the blade surface.

In the steam turbine stationary blade constructed as mentioned above, the drain attaching to the blade surface on the ventral side comes into the ventral slits 10 to 20, provided along an entire length of the blade, from their surface openings to flow into the trailing edge side hollow 5. Also, the drain on the dorsal side flows into the leading edge side hollow 4 through the dorsal slits 21 to 26.

The hollows 4, 5 are sectioned by the rib 6 to be independent of each other. The drain entering the hollow 4 moves along an inner wall of the hollow 4 to flow out of the outer shroud 2 or the inner shroud 3 to be recovered into a condenser (not shown) as drain 43, 41 via a pipe system (not shown). Also, the drain entering the hollow 5 moves along an inner wall of the hollow 5 to flow out of the outer shroud 2 or the inner shroud 3 to be recovered into the condenser as drain 42, 40 via the pipe system.

According to the structure of the mentioned stationary blade 1, there are provided in the blade the leading edge side hollow 4 and the trailing edge side hollow 5 which are sectioned by the rib 6 to be independent of each other. As a result, no case occurs where the drain which has entered these hollows 4, 5 flows toward the slits of the ventral side from those of the dorsal side, or toward the slits of the dorsal side from those of the ventral side reversely, to flow out of the blade surface and the drain having so entered the hollows 4, 5 can be recovered securely.

In the prior art case, there is provided the single hollow 32 to communicate both with the ventral slits 33, 34 and the dorsal slits 35 so that a case may occur where the drain entering the hollow 32 flows to the ventral side from the dorsal side, or reversely thereof, to flow out of the blade surface again. In the present invention, there are no such shortcomings and the drain recovery efficiency can be enhanced.

It is understood that the invention is not confined to the particular construction and arrangement of parts herein illustrated and described but embraces such modified forms thereof as come within the scope of the appended claim.

What is claimed is:

1. A steam turbine stationary blade comprising a blade having a ventral side and a dorsal side, an outer shroud and an inner shroud located on opposite ends of said blade, a leading edge side hollow located in a leading edge side of said blade and a trailing edge side hollow located in a trailing edge side of said blade, the leading edge side hollow and the trailing edge side hollow being independent of each other and both passing from said outer shroud to said inner shroud through an interior of said blade, and a plurality of slits formed on the ventral side and the dorsal side of said blade, the plurality of slits being operable to recover drain, wherein the plurality of slits located on the ventral side of the blade extend in a lengthwise direction of said blade and communicate with the trailing edge side hollow and the plurality of slits located on the dorsal side of said blade extend in the lengthwise direction of said blade and communicate with the leading edge side hollow.

2. A steam turbine blade according to claim 1, wherein the plurality of slits formed on the ventral side of said blade are in two parallel rows which extend in the lengthwise direction of said blade.

3. A steam turbine blade according to claim 2, wherein the two parallel rows are separated by a distance of 8 mm.

4. A steam turbine blade according to claim 1, wherein each of the plurality of slits formed on the ventral side of said blade has rounded edges on a side facing out from said blade.

5. A steam turbine blade according to claim 1, wherein each of the plurality of slits formed on the ventral side and on the dorsal side of said blade has a width of 2 mm.

* * * * *